United States Patent [19]

Whitaker

[11] 4,213,529

[45] Jul. 22, 1980

[54] MEANS FOR STACKING AND SHIPPING CONTAINERS IN MULTIPLES

[75] Inventor: James L. Whitaker, Ft. Lauderdale, Fla.

[73] Assignee: Frank B. Robb, Willoughby, Ohio ; a part interest

[21] Appl. No.: 31,934

[22] Filed: Apr. 20, 1979

[51] Int. Cl.[2] ..... B65D 85/62; B65D 19/00

[52] U.S. Cl. ..... 206/427; 206/431; 206/497; 206/409; 206/602

[58] Field of Search ..... 206/427, 431, 432, 497, 206/602, 409

[56] References Cited

U.S. PATENT DOCUMENTS

| | | | |
|---|---|---|---|
| 3,384,229 | 5/1968 | Kascayk et al. | 206/431 |
| 3,493,106 | 2/1970 | Galli | 206/497 |
| 3,944,070 | 3/1976 | Cardwell et al. | 206/497 |

*Primary Examiner*—William T. Dixson, Jr.
*Attorney, Agent, or Firm*—Frank B. Robb

[57] ABSTRACT

There is disclosed shipping package construction, wherein articles of uniform configuration are positioned in clusters and supported between tray-like members which conform to certain portions of the articles to maintain them in position, which enables such articles to be handled in large quantity, the tray-like members being very light in weight yet formed to incorporate rigidity and strength, the ability to stack the packages formed thereby, being essential and the strength to support such packages in stacked position being in part derived from the members, and the configuration of the parts.

10 Claims, 10 Drawing Figures

MEANS FOR STACKING AND SHIPPING CONTAINERS IN MULTIPLES

BACKGROUND AND HISTORY OF THE INVENTION

The necessity to handle large volumes of articles, such as milk containers or other dairy product containers, which have been distributed in one way or another for many, many years from central establishments to outlying communities and individuals, has provided many problems, and although not limited to dairy products, particularly important with respect thereto since the current form of package in which the dairy products are contained, fluid dairy products primarily, is a coated paper carton or the like.

Such coated paper cartons which may be of any preferred manufacture and in most cases are rectilinear with the top closed to form a ridge like closure portion, are handled in various ways in bulk so to speak but usually in cases, the cases in many instances being made of wood, wire, or plastic, whether reinforced or not and which require substantial cost to construct, maintain and necessarily to return to the origin, or to come central place where they may be distributed for re-use.

Where such cases have been used, the initial cost thereof is substantial and in an endeavor to overcome some of the problems involved, molded cases of one kind or another such as fiberglas and fiberglas composition together with various means to rigidify the same have been adopted and are used.

All the foregoing however involve the necessity to clean, and return, as well as to maintain and protect because of the investment therein and to prevent them from being pilfered and used for other products than those for which they were intended.

There are other ways of handling cartons of milk or milk products or other products in addition such as placing several in corrugated or other paper cartons which however require substantial cost to assemble and necessarily result in loss since they are damaged in transit and thus not reusable in the ordinary sense, for the original purpose particularly since they are often times soiled and otherwise damaged which prevents their re-use per se even if certain government regulations are complied with.

With the foregoing in mind then it is obviously desirable to provide some other means of transporting cartons of milk or milk products or even other kinds of products in a way which will overcome some or all of the problems suggested by the foregoing which in summary may primarily reside in the cost of handling and any overall reduction in such cost will obviously be of advantage not only from the standpoint of conservation of material but of effort and actual space if possible so as to reduce such space as well as the ever present necessity of providing the usual power and raw material which is dependent in many cases upon the supply of oil or oil derived products ultimately.

The present invention substantially reduces the objectional factors which are suggested in the foregoing outline, and provides additionally certain improved handling characteristics, residing largely in the fact that a light weight relatively inexpensive shipping package can be provided by the concept hereof which involves the provision basically of a pair of tray-like members which are in turn formed of plastic such as polypropylene or similar plastic which may be molded or formed in various ways, and which take advantage of some of the characteristics which are present but which are accentuated and changed by the arrangement of the various elements thereof to provide a package which is light, can be re-used, may be disposed of, or otherwise treated in a substantially different manner from common presently known ways of shipping products which involve uniform or similar substantially identical containers or articles.

Turning now to a consideration of the details of the invention, the same are described in the appended specification, in the various configurations described, and are shown in the drawings appended hereto which are embodied in figures as follows:

DESCRIPTION OF THE INVENTION

Figure 1:
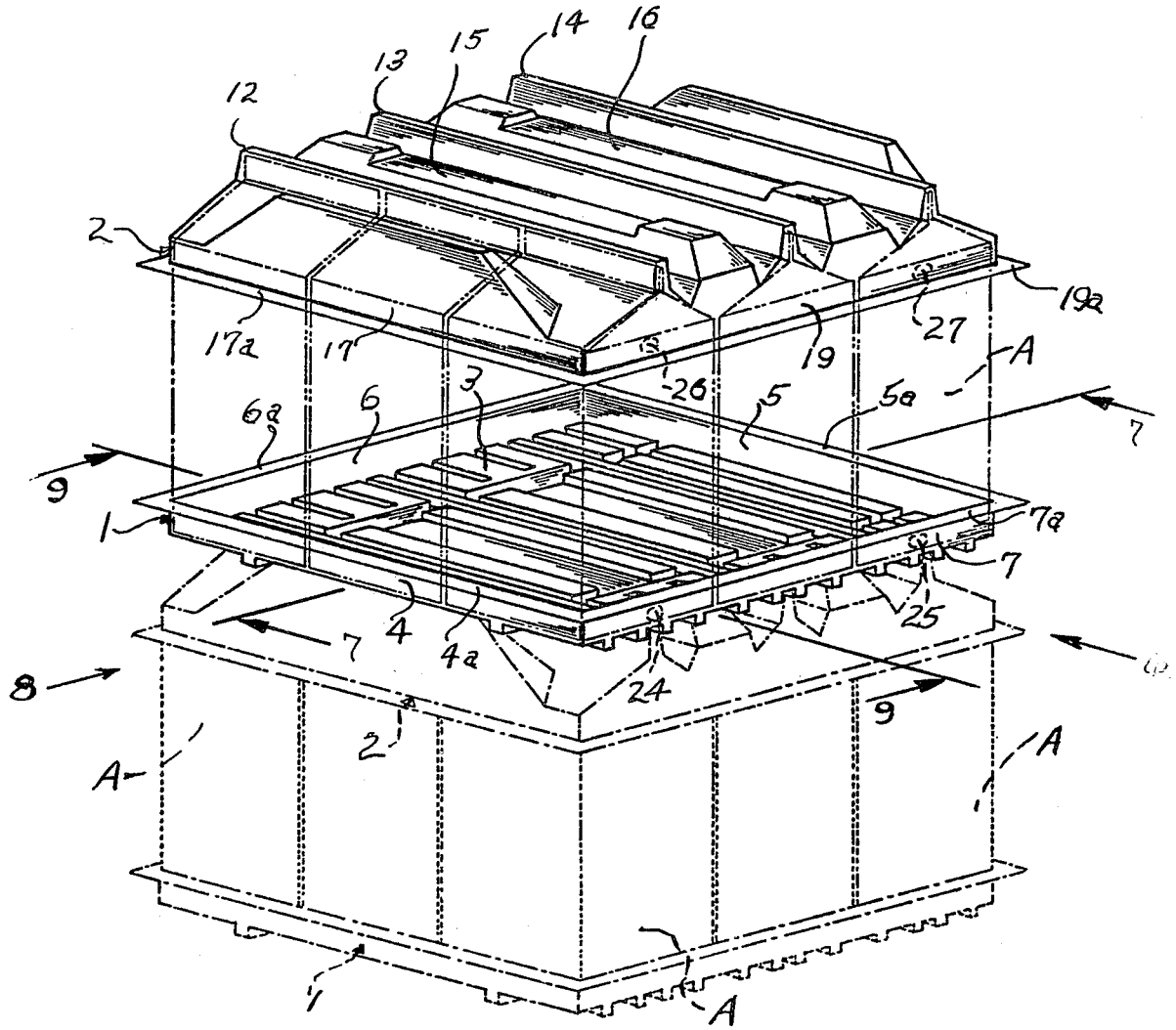
FIG. 1 is a perspective view showing a shipping package of this invention, with a similar package positioned therebeneath in dotted lines and the articles in the shipping package in dotted lines.

Turning now to a consideration of FIG. 1 initially, it will be noted that the shipping package hereof comprises a pair of members which are arranged in a position at the upper and lower ends of containers, in this instance milk carton containers which are well known, and which themselves comprise the generally rectilinear bodies A having the flat bottoms of usual form and the sloping upper ends forming the closures thereof which terminate in a ridge extending transversely of the carton which in this instance is comprised of a coated paperboard or like material of any preferred composition to enable the transport therein of fluid or similar material in a sanitary condition.

It will be observed that the package of this invention is arranged to support a series of such cartons A in juxtaposition, in fact contacting one another, as shown these being half gallon cartons A, and it will be understood that nine of these cartons are intended to be supported in the shipping package hereof, the number and form referred to, being exemplary and not intended to be limiting.

With the foregoing in mind, the novel details of the package reside in the upper and lower members, the lower member being designated the first member 1 and the upper member the second member 2.

These members are tray-like in essence, and are formed as will be described subsequently in detail so as to have mating means on the first member arranged to coact with engaging means of the second member when the packages are piled one above the other in stacked aligned relationship.

Turning to a specific discussion of the tray-like member 1 or first member previously denoted, it will be understood that the same comprises a main or body area which is designated 3, having extending around its periphery at the sides, the elements 4 and 5 constituting upstanding lip portions, these lip portions 4 and 5 extending along what will be arbitrarily termed the transverse edges of the member 1.

Along the other edges of such body, and designated 6 and 7, comprising longitudinal lip members, the members 4,5,6 and 7 consituting a continuous peripheral lip extending completely around the body 3 of the member 1.

The peripheral lip comprised as stated, is additionally furnished in each case with an offstanding edge portion designated 4*a*, 5*a*, 6*a* and 7*a*, integral with the lips 4,5,6 and 7 respectively.

It will thus be seen that the member 1 is in fact a tray-like member, with the lip extending at and along the transverse sides and additionally at the longitudinal sides 6 and 7.

The body 3 of the tray-like member 1 is formed to provide the broadly denoted mating means with aligning instrumentalities designated 8 and 9, being provided in three separate positions in the body 3 and in the form of downwardly extending ridges which are arranged in pairs and adapted to be positioned at both sides of parts of a second member in a manner to be subsequently described.

These pairs of ridges, additionally stiffen the member 1, since these tray-like members are intended to be formed of a very thin polyethylene material which may be manufactured by vacuum forming, the thickness of the material being on the order of 10 mils, though such thickness may be substantially greater limited only by economic factors, and by the chosen method of manufacture including injection or other molding process.

The manufacturing process in effect provides an integral tray-like member, and in addition to the transverse ribs 8 and 9 other ribs are provided to additionally and further stiffen the entire tray-like member to perform its supporting function in the package which will finally be described.

Figure 6:
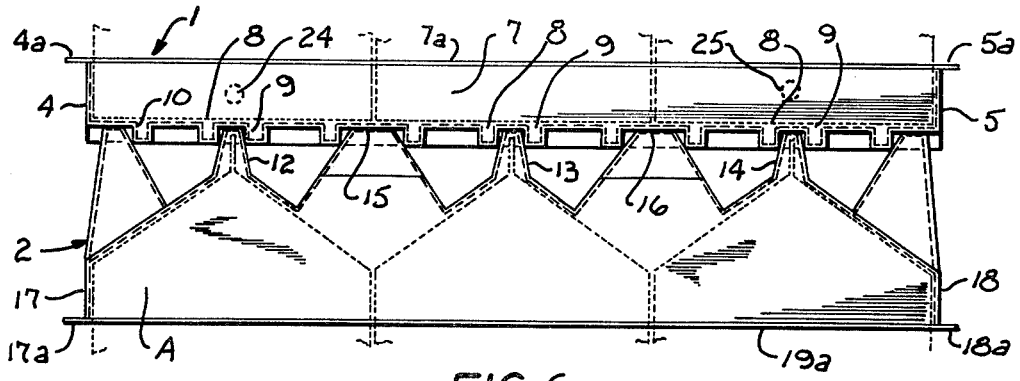
FIG. 6 is a fragmentary view showing the manner of inter-engagement of the upper and lower members of identical packages when positioned in stacked relationship.
Figure 7:
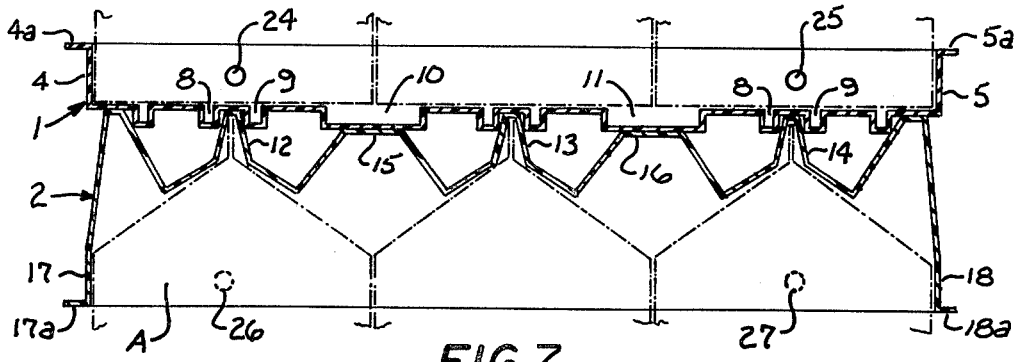
FIG. 7 is a side sectional view taken about as suggested in FIG. 1 on the line 7—7 looking in the direction of the arrows.
Figure 8:
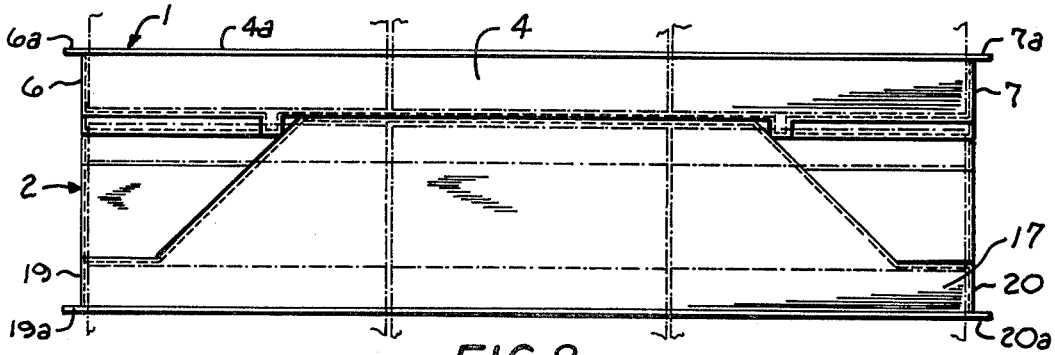
FIG. 8 is an end view taken from the left of the perspective view of FIG. 1 showing fragments of upper and lower members and as though packages were in stacked relationship.
Figure 9:
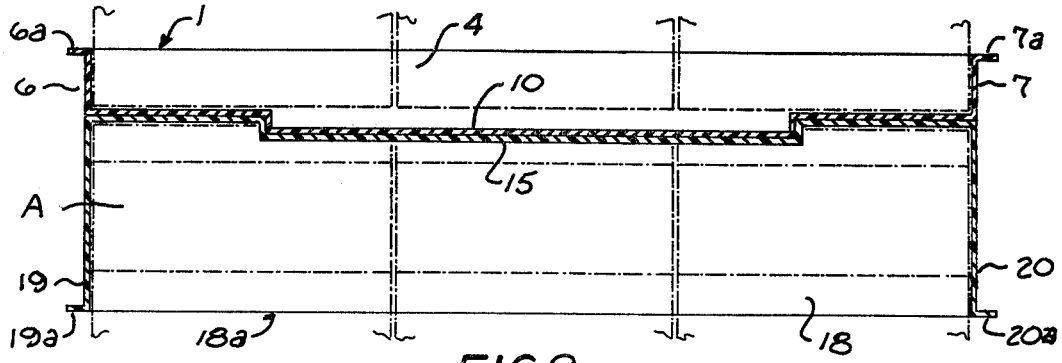
FIG. 9 is an end sectional view taken about as suggested in FIG. 1 by the line indicated at 9—9 looking in the direction of the arrows therein to show the inter-engagement of the respective parts.

The tray-like member 1 or first member as to the mating means thereof is additionally provided with what are termed positioning instrumentalities which likewise extend transversely of the body 3 and are designated 10 and 11, being shown in greater detail in FIGS. 6 and 7 as well as FIG. 8 and 9. These positioning instrumentalities extend downwardly integral with the body 3 and are formed in the process of manufacture of the member 1.

The first member or lower member having been described as to the mating means thereof, is arranged so as to mate with the second member designated 2 and previously mentioned, and now to be described.

The second member being tray-like is provided with the engaging means heretofore generally referred to which include aligning parts extending transversely and designated 12, 13, and 14 which are in the form of ridges and because the tray-like member 2 is in effect reversed in position so as to open downwardly, the ridges 12, 13 and 14 extend upwardly therefrom as shown in FIG. 1 and other figures likewise.

Additionally, certain positioning parts designated 15 and 16 extend transversely of the member 2, and are in the form of recessed elements arranged to receive the downwardly extending positioning instrumentalities previously mentioned and specifically denoted 10 and 11, in a manner as suggested in FIG. 9, and shown clearly in FIG. 7 as to the formation thereof.

It is necessarily noted that the second member 2 is provided with a peripheral lip including the lip members 17 arranged transversely, lip members 18 being opposite thereto. The other lip portions 19 and 20 are of somewhat greater extent because of the overall configuration of the member now being described.

As a matter of fact the members and portions 17, 18, 19 and 20, form a continuous peripheral lip, the portions 19 and 20 extending in what has been arbitrarily described as the longitudinal direction.

The peripheral lip also includes the offstanding portion for each designated respectively 17*a*, 18*a*, 19*a* and 20*a* being similar to the offstanding portions of the member 1 and provides integral oppositely disposed elements, all of these respective parts effecting stiffening action for the respective members as will be understood.

It is noted that the form of the member 2 is such as to conform to the upper ends of the packages A positioned therebeneath and by reason of the configuration additional stiffness is imparted to the body thereof which is likewise formed of polyethylene material for example and of like thickness on the order of about 10 mils.

It will be observed that the peculiar formation of the member 2 is one which makes for relatively rigid construction and is may be formed by a vacuum forming process preferably although not limited thereto, and thus is desirably strengthened by the rigidfying elements formed therein and described in detail heretofore.

Since the material of which the respective members 1 and 2 are formed, provides relatively rigid parts having stiffening formations molded therein, when they are placed in the tray positions mentioned and disclosed in FIG. 1 for example, at the upper and lower ends of the cartons A and being rectilinear as stated, will form a columnar mass, of rather substantial rigidity.

By suitably selecting the material and proportioning the tray-like members 1 and 2 as to the elements described in detail, particularly the peripheral lips formed by the members or portions 4, 5, 6 and 7 and 17, 18, 19 and 20, when the articles, such as those shown at A, are positioned between said members 1 and 2, the articles will be tightly gripped by both and form a package such as shown in full lines in FIG. 1, which can be handled readily.

It is contemplated that other types of plastic material may be used, such as those having an elastic memory of particular form and known as "shrink" materials, in which instance, suitable proportioning in formation, and subsequent application of heat thereto will cause such materials to contract and even more tightly grip containers or articles confined therein and therebetween.

Where the articles are susceptible of positioning in juxtaposition as shown in FIG. 1, the ridigity provided, makes possible the stacking of several such packages as suggested in that Figure, even to a height of three to five such packages, limited only by the columnar strength derived from the material.

While rectilinear containers are shown, it is possible to use the members 1 and 2 for other shapes of such articles as A, where said members may be formed to grip the respective portions of such articles.

It may be necessary or desirable to fasten the members 1 and 2 to the adjacent ends of articles such as A and in that case other means may be restored to for that purpose.

As one example of such means, the interior portions of the members 1 and 2 at the lip areas thereof may be provided with suitable adhesive suggested at 24 and 25 in FIG. 6, with like adhesive at 26 and 27 provided for the upper member 2 as shown in FIG. 7 as well as FIG. 1.

The adhesive may be of such a nature as to adhere to the cartons at the points noted to maintain the tray-like members in their connected relationship with the cartons A.

It is to be understood that the use of the adhesive suggested at 24 and 25, as well as 26 and 27 is only to maintain the respective tray-like members 1 and 2 in position during initial handling and storage, the members 1 and 2 being removable easily by suitable manipulation of the peripheral lips where the adhesive is used.

It is also contemplated that suitable heat welding technique may be resorted to in place of the adhesive, thus being effected in small areas comparable to that indicated for the adhesive.

The use of the adhesive or welding such as suggested at 24 to 27 inclusive is only such as to make the package able to be handled and not such as to damage the cartons when the respective tray-like members are removed therefrom.

The peculiar formation of the tray-like members 1 and 2, and specifically the engaging and mating means of the respective parts, is specifically to provide for stacking of the packages as suggested in FIG. 1 by the phantom view provided therein.

It will be noted that the aligning parts 12, 13 and 14 of the member 2 being in the form of ridges, as shown in FIG. 6, are adapted to be positioned between the downwardly extending ridges 8 and 9 of the member 1 when such a member is positioned thereabove.

This inter-relationship will prevent longitudinal movement of the respective packages in the position shown because of this inter-engaging relationship.

The positioning instrumentalities which extend likewise transversely and are noted at 10 and 11 will be located in the recessed elements 15 and 16 of the member 2, and prevent transverse movement of the tray-like member 1, by reason of the interengaging action of the respective parts.

It will thus be seen that both transverse and longitudinal movement are inhibited, and that a series of such packages can be arranged in vertical alignment and maintained in that position.

The fact that the cartons A are in effect columnar elements, and stiffened by the tray-like members 1 and 2 associated therewith, and held in engagement with the cartons, will permit substantially great height of stacking in the order of 3,4 or even 5 packages one above the other since they are arranged to inter-engage and thus prevent movement relative one another enabling the handling of the same in columns of several packages.

The formation of the respective members 1 and 2 as heretofore noted does in fact impart substantial rigidity thereto there being other and additional ridges and formations provided in the respective parts to increase the stiffness there of but not referred to in detail. Additional different formations may also be molded in the parts which further add to the stiffness and strength because of the peculiar nature of the material and the fact that these formations impart stiffness.

It is understood that the inter-engaging aspect of the respective parts enables the packages to be piled to substantial height and when the contents are to be dispensed from the cartons or articles such as A, the material of which the tray-like members are formed is such that it may be disposed of for recycling, or in fact if it is desired, returned to the packager for reuse if conditions permit.

In actual shipping of the respective tray-like parts separately from assembled packages, the fact that they will nest one within the other as to the members 1 and likewise separately as to the members 2, is a further desirable aspect because it effects compact shipping and supply for ultimate combination in pacakages along the lines herein set forth.

Figure 10:
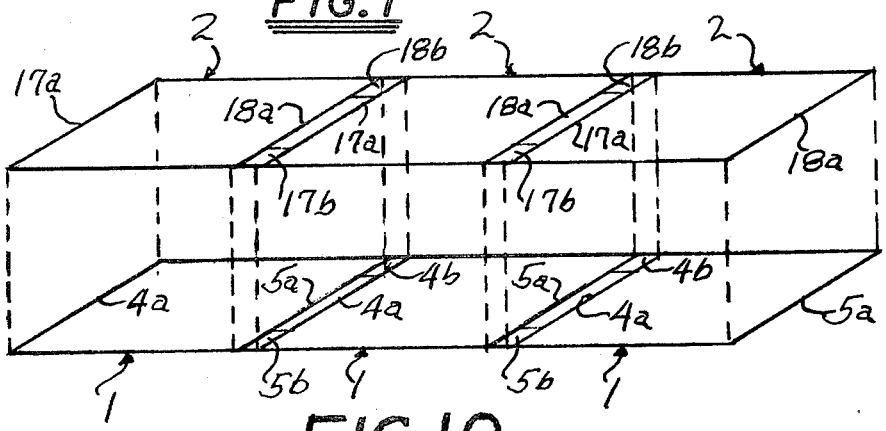
FIG. 10 is a diagrammatic disclosure of an arrangement of a series of packages.
Figure 2:
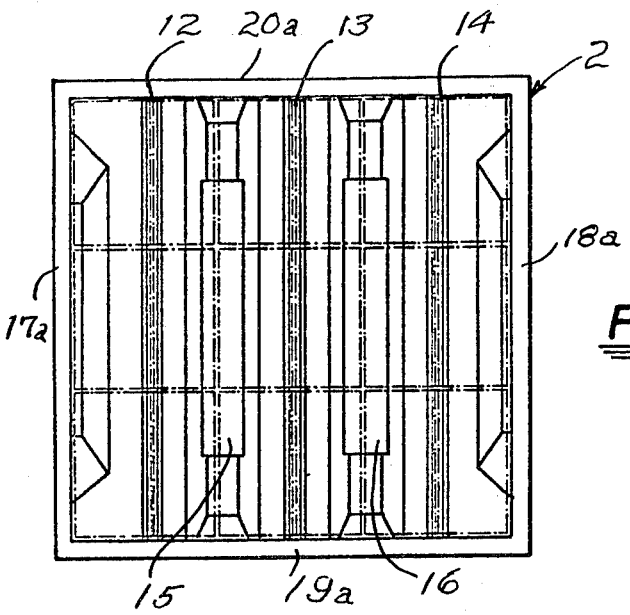
FIG. 2 is a top view of one of the members of the package.
Figure 3:
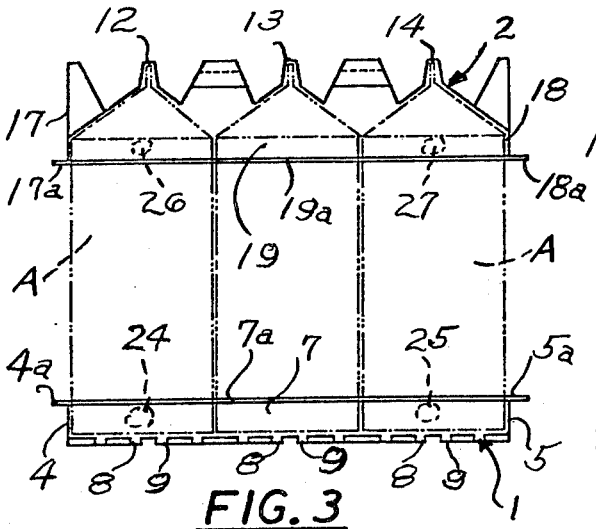
FIG. 3 is a side view of the package showing the upper and lower members with the articles, in dotted lines.
Figure 4:
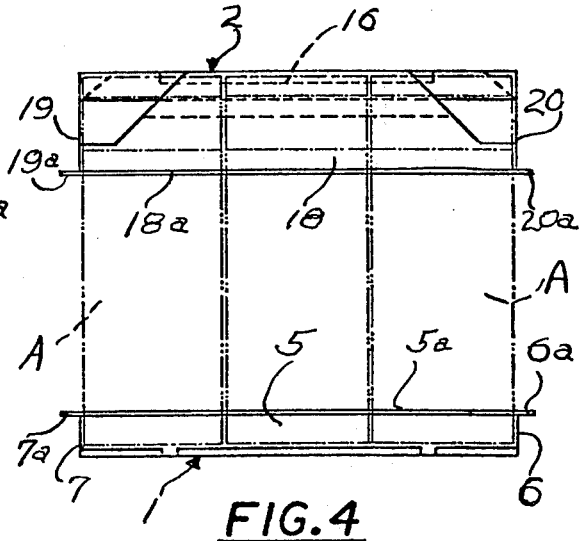
FIG. 4 is an end view of the package of FIG. 3.
Figure 5:
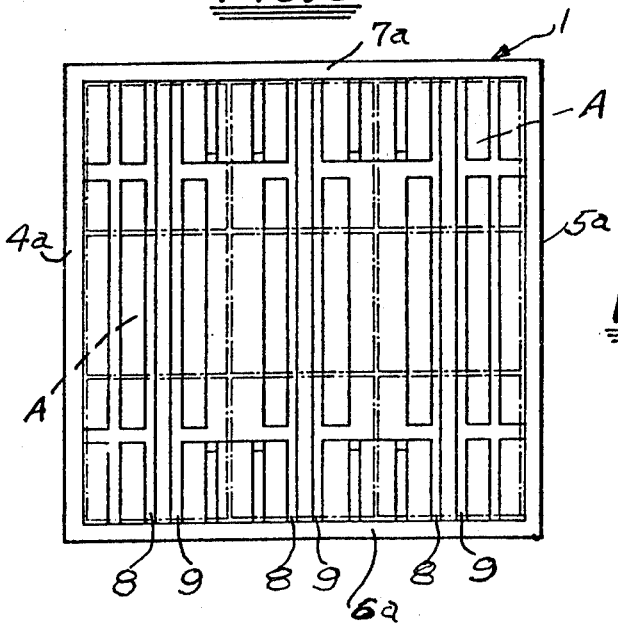
FIG. 5 is a bottom view of the package of FIG. 3.

Under certain manufacturing and handling conditions, the ability to handle a horizontally aligned series of packages embodying the tray-like members 1 and 2 such as diagrammatically disclosed in FIG. 10, is particularly advantageous.

Here the lower tray-like members 1 are shown as formed during initial manufacturing in strips, with the edge portions **5*a* connected to the edge portions 4*a* of adjoining members. In this instance three such members 1 are connected, and such connection need not be continuous but may be only at accessible portions 5*b* and 4*b*** for example, sufficient to maintain the members positioned during handling, but easily severed when individual packages are to be handled as such.

The members 2 will also be connected as shown, with edge portions **18*a* and 17*a* connected at 17*b* and 18*b* similarly as 4*b* and 5*b***, to be severed likewise when necessary.

The series of packages suggested will enable the handling of a plurality of series on skids with even greater facility then in instances where individual packages are arranged in like manner, the stability provided thereby, being an important factor in storage and distribution areas.

It may be that only edged portions of members 2 will be desirable to connect while corresponding edge portions of members 1, will remain unconnected for certain conditions of use, in which instance certain advantages will still accrue for handling.

I claim:

1. A stackable shipping package comprising a pair of tray-like members of relatively thin material which is stiffened by the formation in manufacture, between and by which members, a series of articles is supported, each member having a body conforming at least in part to the portion of such article adjacent thereto, and each member having a peripheral lip thereon and within which such articles are confined in juxtaposition, each of said members further having engaging means to interengage corresponding means of like packages respectively above and below such package, all such packages being thereby positioned in vertically arranged relationship.

2. A shipping package as claimed in claim 1, wherein the pair of tray-like members comprise a first member having a body on which the said articles are supported, said body including aligning instrumentalities formed therein, as part of the stiffening thereof and a second member having a body with aligning parts formed therein, in like manner, correspnding to said instrumentalities for mating therewith when the same are incorporated in separate packages arranged one above the other.

3. A shipping package as claimed in claim 2, wherein the body of said first member is also formed with positioning instrumentalities arranged to stiffen the said body, and the second member has positioning parts similarly arranged in like manner for mating with corresponding positioning instrumentalities when the same are incorporated in separate packages arranged one above the other.

4. A shipping package as claimed in claim 1, wherein mating means are incorporated in the first member to impart strength thereto and engaging means are incorporated in the second member to impart strength thereto, said mating means likewise formed to prevent displacement of a second package of substantially identical form in which engaging means like those described are incorporated, when such second package is positioned with the said engaging means thereof in engagement with the mating means first mentioned, the engaging means comprise aligning parts at least partially conforming to the upper ends of the articles supported in the package, and include transverse ridges, the mating means comprise aligning instrumentalities consisting of transverse grooves adapted to receive such ridges therein and thereby limit relative longitudinal movement when so positioned, the engaging means also having recessed portions constituting positioning parts in transverse alignment to co-act with positioning instrumentalities comprising transverse portions formed in the mating means to limit transverse movement when the respective recessed portions and transverse portions are inter-engaged, all of said ridges and means being arranged to stiffen the respective members in which they are formed.

5. A package as claimed in claim 1, wherein adhesive means is provided for each lip to fasten the tray-like members to the portions of the articles in contact therewith.

6. A package as claimed in claim 1, wherein means are provided to fasten the tray-like members to the portions of the articles in contact with said members.

7. A package as claimed in claim 1, wherein the tray-like members are formed of a plastic having a shrink characteristics whereby heating of the same after formation whilst in position with respect to the articles therebetween will cause said members to grip said articles to resist displacement of said members.

8. A package as claimed in claim 1, wherein said members are formed of relatively thin material on the order of between 10 and 30 mils.

9. A series of shipping package as claimed in claim 1, wherein at least two tray-like members of adjacent packages are arranged in horizontal alignment, with contiguous areas having means to severably connect the same.

10. A series of shipping packages as claimed in claim 1, wherein at least two packages are positioned adjacent one another horizontally, the tray-like members are positioned at the upper and lower ends of the series of articles in said packages, the adjacent areas of the members at the upper ends of the articles being arranged in horizontal alignment and contiguous areas thereof having means to severably connect the same.

* * * * *